US010662509B2

(12) United States Patent
Balachandran et al.

(10) Patent No.: US 10,662,509 B2
(45) Date of Patent: May 26, 2020

(54) METHOD FOR MAKING METAL-CARBON COMPOSITES AND COMPOSITIONS

(71) Applicant: UCHICAGO ARGONNE, LLC, Chicago, IL (US)

(72) Inventors: Uthamalingam Balachandran, Willowbrook, IL (US); Beihai Ma, Naperville, IL (US); Stephen E. Dorris, Lagrange Park, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 825 days.

(21) Appl. No.: 15/261,205

(22) Filed: Sep. 9, 2016

(65) Prior Publication Data

US 2018/0073110 A1 Mar. 15, 2018

(51) Int. Cl.
*C22C 32/00* (2006.01)
*B22D 21/00* (2006.01)
(Continued)

(52) U.S. Cl.
CPC ..... *C22C 32/0084* (2013.01); *B22D 21/005* (2013.01); *B22D 23/06* (2013.01);
(Continued)

(58) Field of Classification Search
CPC ..... C22C 32/0084; C22C 1/02; C22C 1/05; C22C 26/00; C22C 2026/002;
(Continued)

(56) References Cited

U.S. PATENT DOCUMENTS 8,541,336 B2 * 9/2013 Shugart ..... C22C 5/02 502/184
8,647,534 B2 * 2/2014 Shugart ..... C04B 35/52 252/503
(Continued)

OTHER PUBLICATIONS

Forrest, D.R. et al., Novel Metal-Matrix Composites with Integrally-Bound Nanoscale Carbon, Proceedings of Nanotech Conference and Expo, Santa Clara, CA, CRC Press (2012).
(Continued)

*Primary Examiner* — John A Hevey
(74) *Attorney, Agent, or Firm* — Olson & Cepuritis, Ltd.

(57) ABSTRACT

A method for making covetic metal-carbon composites or compositions by electron beam melt heating under vacuum (pressure $<10^{-3}$ Torr) is described herein. This fabrication method is advantageous, in that it provides oxygen-free covetic materials in a process that allows precise control of the composition of the covetic material to be produced. The method described herein also can be applied to produce multi-element-carbon composites within a metal or alloy matrix, including high melting temperature materials such as ceramic particles or prefabricated nano- or micro-structures, such as carbon nanotubes or graphene compounds. The covetic reaction between metal and carbon takes place under the influence of flowing electrons through the melted metal-carbon precursor. This process creates strong bonding between nanocarbon structure and the metal elements in the melt.

16 Claims, 3 Drawing Sheets

(51) Int. Cl.

| | |
|---|---|
| ***B22D 23/06*** | (2006.01) |
| ***B22D 29/00*** | (2006.01) |
| ***B22D 30/00*** | (2006.01) |
| ***F27D 11/12*** | (2006.01) |
| ***F27D 13/00*** | (2006.01) |
| ***F27B 17/00*** | (2006.01) |
| ***F27D 7/06*** | (2006.01) |
| ***B22D 27/15*** | (2006.01) |
| ***C22C 1/05*** | (2006.01) |
| ***C22C 26/00*** | (2006.01) |
| ***C22C 1/02*** | (2006.01) |
| ***C22C 1/10*** | (2006.01) |

(52) U.S. Cl.
CPC ..... *B22D 27/15* (2013.01); *B22D 29/00* (2013.01); *B22D 30/00* (2013.01); *C22C 1/02* (2013.01); *C22C 1/05* (2013.01); *C22C 26/00* (2013.01); *F27B 17/0016* (2013.01); *F27D 7/06* (2013.01); *F27D 11/12* (2013.01); *F27D 13/00* (2013.01); *B22F 2999/00* (2013.01); *C22C 2001/1047* (2013.01); *C22C 2026/002* (2013.01); *F27D 2007/066* (2013.01)

(58) Field of Classification Search
CPC ..... C22C 2001/1047; F27B 17/0016; F27D 13/00; F27D 11/12; F27D 7/06; F27D 2007/066; B22D 27/15; B22D 30/00; B22D 29/00; B22D 23/06; B22D 21/005; B22F 2999/00
See application file for complete search history.

(56) References Cited

U.S. PATENT DOCUMENTS

| | | | | |
|---|---|---|---|---|
| 8,748,773 | B2 * | 6/2014 | Forbes Jones | B22D 11/11 164/250.1 |
| 9,273,380 | B2 * | 3/2016 | Shugart | C22C 21/02 |
| 10,072,319 | B2 * | 9/2018 | Braydich | C22C 21/00 |
| 2009/0176090 | A1 * | 7/2009 | So | C22C 32/0084 428/367 |
| 2016/0101398 | A1 | 4/2016 | Worsley et al. | |

OTHER PUBLICATIONS

Knych, T. et al., Fabrication and Cold Drawing of Copper Covetic Nanostructured Carbon Composites, Archives of Metallurgy and Materials 59 (4), 1283-1286 (2014).

Salamanca-Riba, L. et al., A New Type of Carbon Nanostructure Formed Within a Metal-Matrix, Presented at Tech Connect World, Santa Clara, CA (2012).

* cited by examiner (A) Invention (B) Prior Art

METHOD FOR MAKING METAL-CARBON COMPOSITES AND COMPOSITIONS

STATEMENT OF GOVERNMENT INTEREST

The United States Government has rights in this invention pursuant to Contract No. DE-AC02-06CH11357 between the United States Government and UChicago Argonne, LLC representing Argonne National Laboratory.

FIELD OF THE INVENTION

This invention relates to a method for making metal-carbon compositions, more specifically, to a method for making covetic metal-carbon composites or compositions.

BACKGROUND

Significant research interest has been attracted to the development of metal-carbon composites and compounds, known as "covetic" materials, in an effort to improve their thermophysical, mechanical, and electrochemical properties. Such materials have a form of nanocarbon dispersed within a metal matrix. The term "covetic" is derived from "covalent" and "metallic", in that there appears to be some type of hybrid bonding with attributes of covalent bonds and of metallic bonds between the metal and the carbon nanoparticles. Added carbon incorporates into the metal matrix and has an effect on several of the properties of the material, such as raising the melting point and significantly altering surface tension, thus porosity during solidification. Covetic materials can improve thermal, electrical, physical, and chemical properties (e.g., corrosion and oxidation resistance) relative to the base metal of the covetic material. Covetic materials have demonstrated the ability to withstand more than 1,500 degrees Celsius under an oxygen plasma lance without separation of carbon and metals. See, for example, the www website graphene-info (dot) com/covetics-hybrids-fuse-carbon-and-metal-strong-bonds. The effects of added carbon depend on the metal used. Copper-carbon composite, for example, can be formed by mechanically introducing carbon to copper metal by lamination, thereby imparting the resulting copper-carbon composite material with improved thermal conductivity over pure copper metal.

Processing methods have been developed for making covetic compositions. For example, metal-carbon compositions have been prepared via mixing carbon powder into melted metal (e.g., Cu, Al, Ag, Au, Fe, Ni, Pt) by stirring and applying a large current of hundreds of amperes (See U.S. Pat. No. 8,647,534), and then solidifying the mixture by cooling. Such metal-carbon compositions stay single phase upon remelting and solidification. Similar to conventional metals, these metal-carbon composites can be rolled into thin sheets, drawn into wires, or machined into parts.

SUMMARY

The conventional processes for making covetic metal-carbon compositions, such as covetic copper-carbon composites (also referred to herein as "covetic copper") are performed in an ambient atmosphere. In the conventional process for preparing covetic copper, copper is melted, carbon powder is stirred into the molten copper, and high current (>100 Amp) is passed through the molten material. One of the downsides of the conventional method is the undesirable formation of copper oxide. With approximately 0.21 atm oxygen in the ambient atmosphere, the formation of copper oxide is not surprising, even with the large amount of carbon powder that is added to the molten copper.

The present invention utilizes an electron beam to heat a copper-carbon mixture under vacuum. Unlike covetic copper made by the conventional process, covetic copper that is produced by electron beam melting under vacuum is substantially free of copper oxide (e.g., no copper oxide particles evident by scanning electron microscopy at resolutions of 0.1 micron or greater, i.e., features of 0.1 micron or smaller are resolved). Copper oxide is a poor thermal and electrical conductor as compared to copper. The electrical conductivity of copper oxide is about 18 orders of magnitude lower than copper. The thermal conductivity of copper oxide is less than 5% that of copper. The presence of copper oxide seriously degrades mechanical properties, i.e., copper oxide is less ductile and less malleable compared to copper. The presence of copper oxide is also an indicator that oxygen levels during prior art processing is sufficiently high to have oxidized carbon that was added.

FIG. 1 shows electron micrograph images for (A) covetic copper produced by electron beam melting under vacuum and (B) covetic copper produced by the conventional covetic process. Examination of the microstructures of both types of covetic copper showed no evidence of copper oxide in the sample made by electron beam melting under vacuum (A). In contrast, multiple oval-shaped particles, identified as copper oxide, with size 0.5-2 μm, were clearly visible in the sample made by the conventional process (B). Copper oxide particles with size of 0.5-2 μm are also evident in a fracture surface electron micrograph image of covetic copper made by the conventional process as shown in FIG. 2.

A method for making covetic metal-carbon composites or compositions by electron beam melt heating under vacuum (pressure $<10^{-3}$ Torr) is described herein. This fabrication method is advantageous, in that it provides oxygen-free covetic materials via a process that allows precise control of the composition of the covetic material to be produced. The electron beam heating process also is amenable to large scale production. The method described herein also can be applied to produce multi-element-carbon composites within a metal (or alloy) matrix, including high melting temperature materials such as ceramic particles or prefabricated nano- or micro-structures (such as carbon nanotubes or graphene compounds). The covetic reaction between metal and carbon takes place under the influence of flowing electrons (electrical current) through the melted metal-carbon precursor. This process creates strong bonding between nano-sized carbon structures and the metal elements in the melt. Covetic copper produced by this method was demonstrated to have surprisingly enhanced electrical conductivity relative to pure copper metal. Depending on the form of carbon used, the electron beam melting process does not require as high a current as conventional methods.

As described herein, a method for preparing a covetic metal-carbon composite material comprising the sequential steps of:

(a) passing an electric current of less than about 1 ampere through a precursor mixture of a metal (e.g., copper) and a carbon material (e.g., about 1 to about 10 percent by weight (wt %) carbon based on the total weight of the precursor mixture) in an electrically conductive, grounded vessel by irradiating the mixture with an electron beam under vacuum at a pressure of less than about $10^{-3}$ Torr, wherein the electron beam has a sufficient beam energy to heat the mixture to a temperature below the melting point of the mixture at a heating rate in the range of about 1 to about 10° C. per minute (° C./min) to expel dissolved gasses therefrom;

(b) increasing the electron beam energy to a level sufficient to heat the precursor composition at a heating rate in the range of about 10 to about 200° C./min to a temperature sufficient to melt the mixture, cause convention mixing therein, and thereby convert the precursor mixture to a covetic metal-carbon composite material;

(c) terminating the electron beam to allow the mixture to cool to ambient room temperature while maintaining the pressure at less than about $10^{-3}$ Torr; and (d) recovering the covetic metal-carbon composite material from the vessel at ambient atmospheric pressure.

In some embodiments, the metal is selected from the group consisting of copper, aluminum, silver, gold, platinum, iron, and nickel. Preferably, the metal is in the form of a powder, such as copper powder and the like.

In some preferred embodiments the carbon material is a particulate carbon material. Preferably, the particulate carbon material comprises carbon microparticles, carbon nanoparticles, or both. The carbon material can be any type of carbon. In some preferred embodiments, the carbon material comprises graphite, carbon black, graphene, carbon nanotubes, carbon nanofibers, or a combination of two or more thereof. Optionally, the carbon nanotubes, carbon nanofibers, or both also can comprise nanoparticles of one or more metal attached to or encapsulated within the fibers and/or nanotubes.

The grounded vessel used in the electron beam heating process is open at the top (e.g., as in a crucible) to allow the electron beam to directly irradiate the precursor mixture of carbon and metal, and is composed of an electrically conductive material capable of handling the temperatures achieved during the process. In some preferred embodiments the vessel is a grounded graphite crucible.

In the present method, the pressure within the reaction chamber housing the electron beam and grounded vessel is preferably in the range of about $10^{-3}$ Torr to about $10^{-7}$ Torr, although even lower pressures are acceptable.

In the present method, the electron beam preferably is continuously rastered or swept across the exposed surface of the precursor mixture in the crucible during step (a), step (b) or both steps (a) and (b).

In some preferred embodiments, the metal comprises copper and the carbon material comprises graphite or carbon black.

Also described herein is a covetic metal-carbon composite produced by the electron beam heating method. Preferably, the metal component of the covetic material is selected from the group consisting of copper, aluminum, silver, gold, platinum, iron, and nickel. Preferably, the metal is in the form of a powder, such as copper powder and the like. Preferably, the carbon material is present at a concentration of about 1 to about 10 percent by weight based on the total weight of the composite. In a covetic metal-carbon composite, metal oxide particles larger than 0.5 μm are not detectable in the composition using electron micrographic analysis.

DETAILED DESCRIPTION

Figure 1:
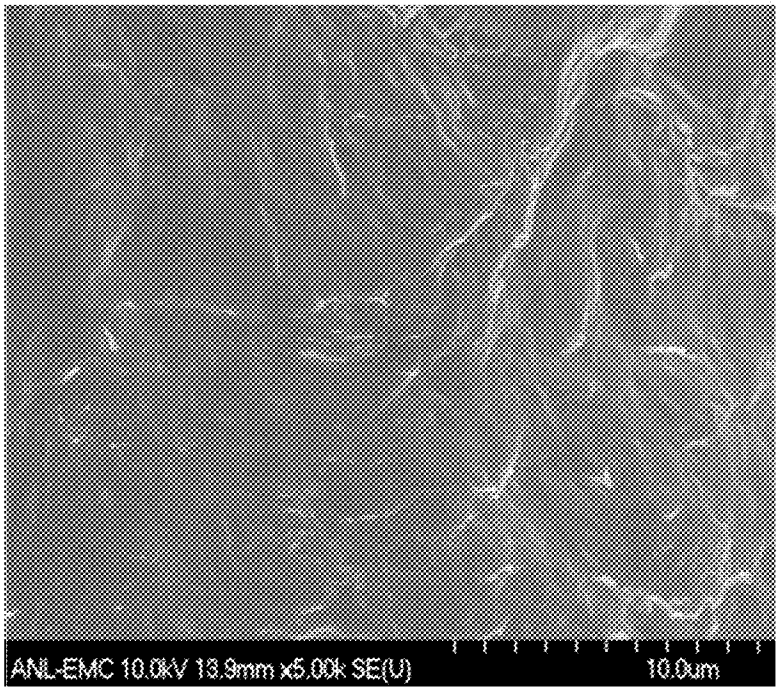
FIG. 1, Panel (A) shows a scanning electron micrograph (SEM) of covetic copper made by vacuum electron beam melting; Panel (B) shows an SEM of covetic copper made by a conventional process. Arrows indicate copper oxide particles.
Figure 1:
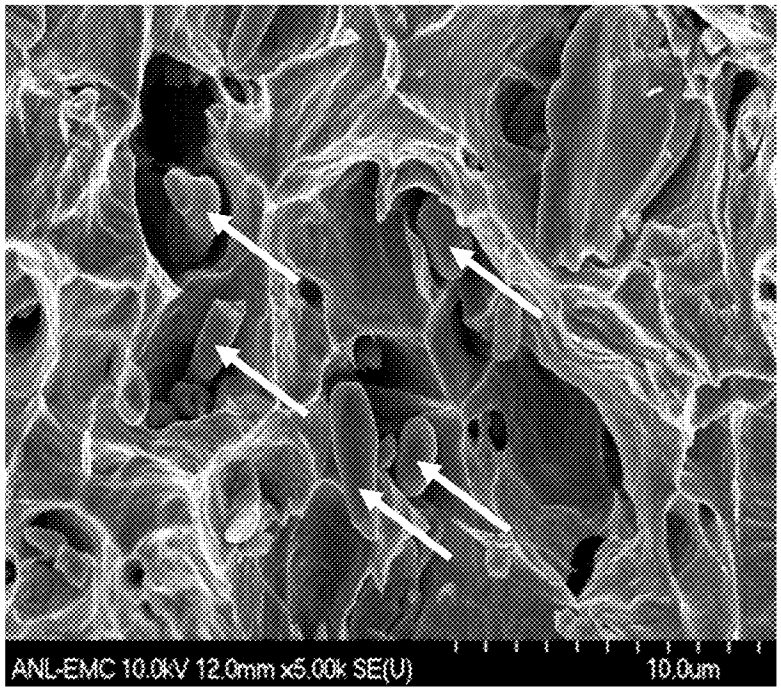
Figure 2:
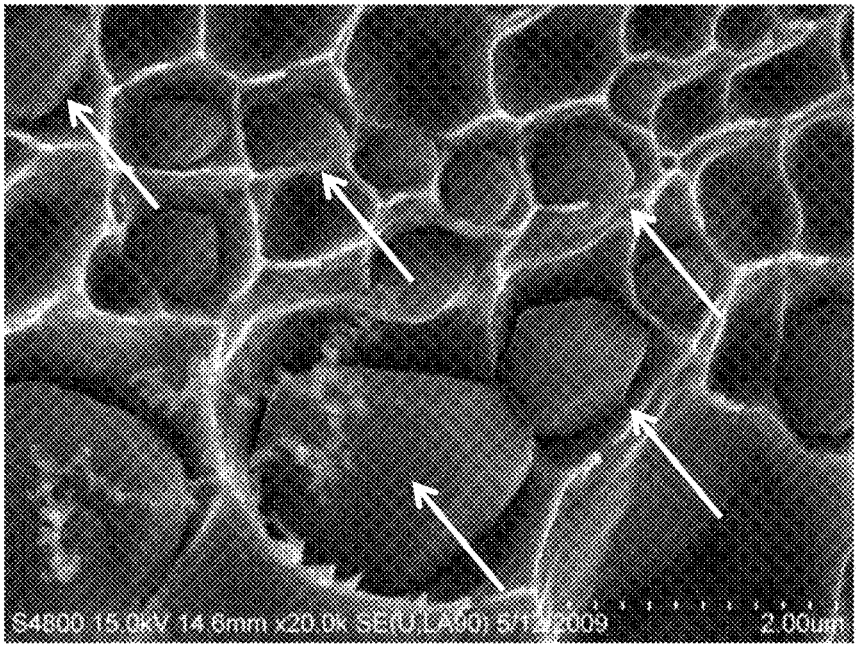
Fig. 2 (Prior Art)
FIG. 2 shows an SEM of covetic copper prepared by a conventional process (U.S. Pat. No. 8,647,534 B2, FIG. 3). Arrows indicate copper oxide particles.

The enhanced properties of covetic metals likely result from carbon nanostructures and networks that form between the metal matrix and carbon nanoparticles. Two distinct carbon nanostructures have been found in covetic materials: (1) carbon clusters with size ranging from a few nanometers (nm) to several hundred nm, and (2) graphene-like carbon nanostructures that become incorporated within the copper lattice. Under conditions that allow formation of copper oxide, such as the conditions encountered during the conventional process, it is likely that the carbon is also oxidized, which causes loss of carbon and disruption of beneficial carbon nanostructures within the material.

When covetic copper is made by electron beam melting under vacuum, loss of carbon is avoided and carbon nanostructures are preserved, which can lead to an enhancement in physical and electrical properties of the covetic material. Table 1 shows the electrical resistance of thin films (approx. 50 nm thick) made from copper electron beam-melted with addition of about 2 wt. % carbon, using graphite as the carbon source, (i.e. covetic copper), and of the same copper without carbon added. The covetic copper described herein showed an unexpected enhancement in conductivity >30%. Copper-carbon composites made using graphite as the carbon source exhibited superior electrical conductivity to copper-carbon composites made using carbon black as the carbon source. In metals and alloys, electrical conductivity and thermal conductivity are strongly correlated, i.e., as one increases so does the other. Use of graphite or graphene as the carbon source also allows for the covetic reaction to take place without having to pass electric currents of the order of hundreds of amperes during the melt phase as is required by the known prior art. See U.S. Pat. Nos. 9,972,380; 8,647,534.

TABLE 1

Electrical Resistance of covetic copper film made from 99% Cu with 2 wt. % graphite by electron-beam melting under vacuum vs. film made from 99% Cu without carbon addition [Thickness of the films ≈50 nm]

| | CuC2G (Cu99 with 2 wt. % Graphite Covetic) | Cu99 (Cu-Parent Metal) |
|---|---|---|
| Test area 1 (mΩ) | 131.7 | 195.1 |
| Test area 2 (mΩ) | 134.0 | 196.6 |
| Test area 3 (mΩ) | 127.6 | 201.0 |
| Test area 4 (mΩ) | 127.0 | 189.3 |
| Test area 5 (mΩ) | 132.7 | 189.7 |
| Average (mΩ) | 130.59 | 194.34 |
| Sheet Resistance (mΩ/square) | 591.89 | 880.80 |

The resistances of the two films [CuC2G (Cu99 with 2 wt. % graphite) and Cu99 (Cu-Parent Metal) were measured at 5 different locations ("areas") and used the average of these five measurements to calculate average sheet resistance.

Covetic materials were also made using another type of copper powder (99.9% Cu powder, referred as Cu99.9) and both graphite and carbon black. Table 2 provides the data for both graphite and carbon black usage. CuC2G in Table 2 stands for Cu99.9 with 2 wt. % Graphite; CuC2B stands for Cu99.9 with 2 wt. % Carbon black. Data for the "parent" Cu99.9 is included in Table 2.

TABLE 2

Electrical resistance of films made from covetic copper that were made from 99.9% Cu with 2 wt. % graphite and 99.9% Cu with 2 wt. % carbon black by electron-beam melting under vacuum vs. films made from 99.9% copper without carbon addition [films ≈45 nm thick]

| | CuC2G (Cu99.9 with 2 wt. % Graphite Covetic) | CuC2B (Cu99.9 with 2 wt. % Carbon Black Covetic) | Cu99.9 (Cu-Parent Metal) |
|---|---|---|---|
| Test area 1 (mΩ) | 165.3 | 218.3 | 224.4 |
| Test area 2 (mΩ) | 176.1 | 211.0 | 224.6 |
| Test area 3 (mΩ) | 151.9 | 207.4 | 208.0 |
| Test area 4 (mΩ) | 152.6 | 210.4 | 217.1 |
| Average (mΩ) | 161.5 | 211.8 | 218.5 |
| Sheet Resistance (mΩ/square) | 731.8 | 959.8 | 990.4 |

Figure 3:
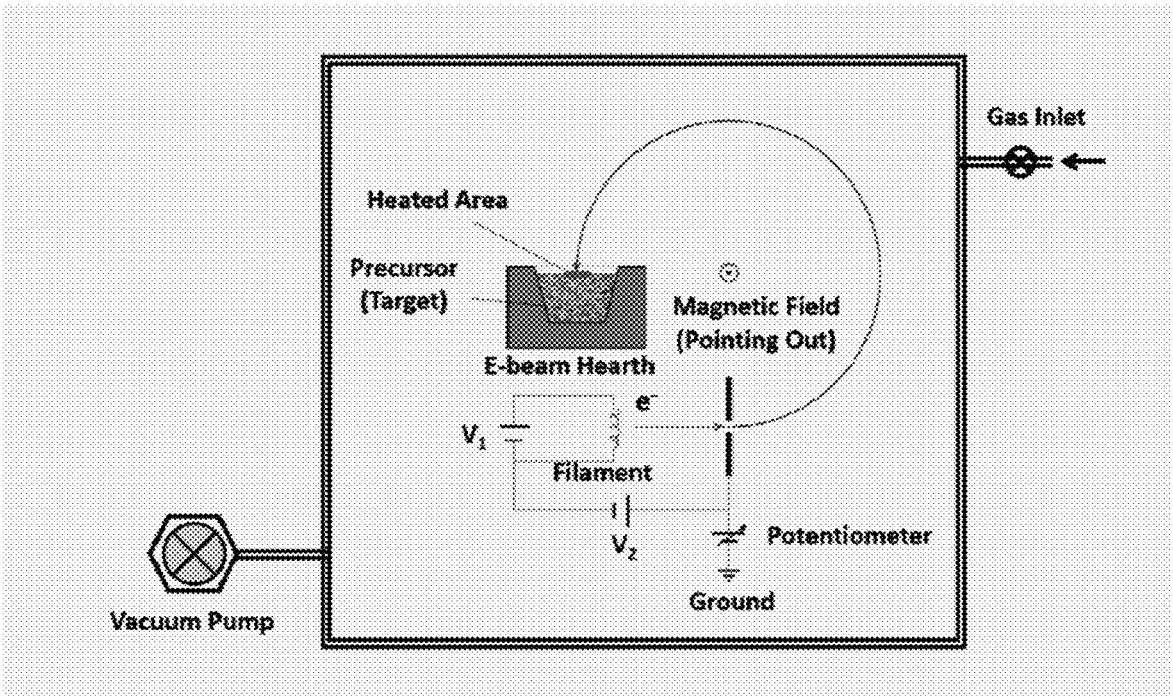
FIG. 3 shows a schematic diagram of an electron beam melting system.

An electron beam melting system is generally made of copper and is cooled by circulating water. As illustrated in FIG. 3, a typical electron beam melting system generates thermal electrons by applying a small (a few volts) voltage ($V_1$) across a tungsten wire filament, which is set at a high negative potential of tens of thousands of volts (typically 3 to 40 KV below the ground). In the system used in the examples described herein, an 8 to 10 KV acceleration voltage ($V_2$) was used. An electron beam is accelerated by $V_2$ and passes through an opening on the anode. The electron beam exiting the opening on the anode is bent by the magnetic field and directed at the precursor (target) mixture of metal and carbon inside a vacuum chamber. When electrons hit the target material, their kinetic energy is converted into thermal energy to heat the material. A small alternating magnetic field superimposed over the bending magnetic field can modulate the position where the electron beam hits the target, e.g., rastering the beam across the target. This modulation can effectively raster or sweep the electron beam over a broader area than a stationary beam, resulting in more uniform heating of the material.

No effect of the sweep pattern or frequency of the beam sweep has been detectable in the resulting product. The rastering of the beam can effectively cause convection in the melted mixture, stirring metal-carbon mixture in the crucible, which is beneficial for achieving uniform heating and miring. Some degree of stirring along with the passing of electrical current through the metal-carbon mixture is important factors for the covetic conversion to occur.

The experimental procedure to make covetic materials using both graphite and carbon black is the same. The procedure for making the covetic samples is provided in Table 3.

TABLE 3

Process for making metal-carbon covetic materials by electron beam melting inside a vacuum processing chamber

| | |
|---|---|
| Preparation of Mixture | Metal and carbon are mixed to form a precursor mixture, e.g. by grinding the materials together. |
| Loading of crucible | The metal-carbon precursor is loaded into a grounded graphite crucible which is placed into an electron beam chamber. The chamber is evacuated to a desired vacuum (e.g. less than $10^{-3}$ Torr). |
| Degassing | The metal-carbon precursor is then slowly degassed by increasing the beam-induced current up to about 200 mA while maintaining the pressure of the electron beam chamber at $10^{-4}$ Torr or less. |
| Melting and Covetic Reaction | The metal-carbon precursor is then melted by increasing the power of the electron beam to heat the precursor to or above its melting point. The movement of the electron beam can be controlled by beam manipulation or rastering. A fast moving, rastered electron beam causes stirring of the precursor melt and facilitates the covetic reaction. |
| Cooling | After the precursor melt has been stirred by the convection caused by the rastering of the beam, the electron beam is turned off, and the melt cools and solidifies |
| Removal from chamber | After cooling to about ambient room temperature, the electron beam chamber is pressurized to ambient pressure, and is opened to remove the covetic metal-carbon composite. |

Figure 4:
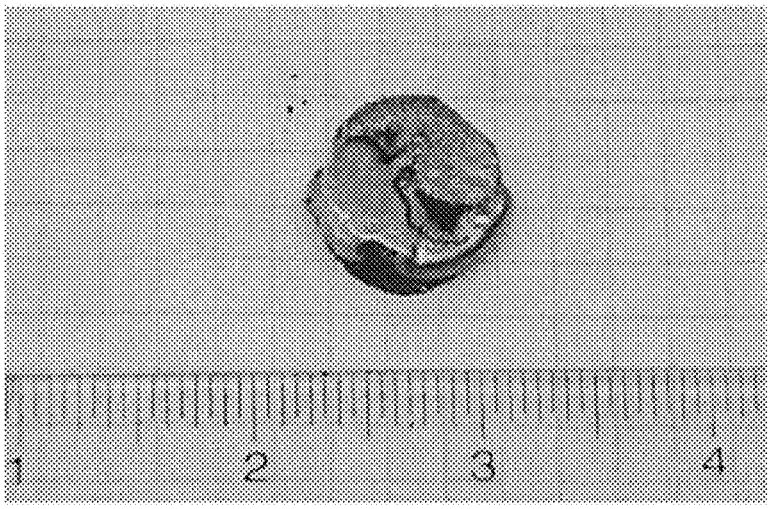
FIG. 4 shows a sample of a copper covetic with 5 wt % carbon produced by electron beam melting inside a vacuum processing chamber.
Figure 5:
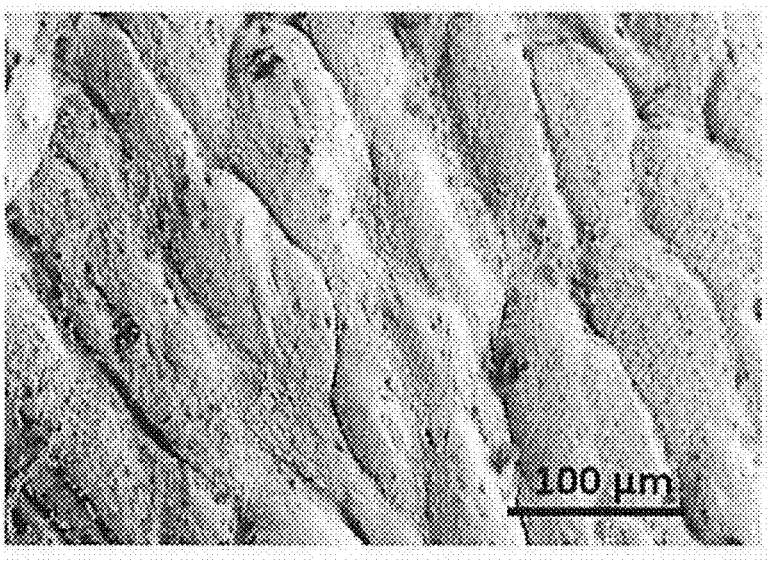
FIG. 5 provides an SEM image of an as-solidified surface of covetic copper material with approximately 5 wt % carbon produced by electron beam melting inside a vacuum chamber.

FIG. 4 shows a photograph of a sample of covetic copper produced by the electron beam method described herein using 5 wt % graphite after cooling to room temperature and removing from the electron beam melt processing chamber. FIG. 5 shows a scanning electron microscopy (SEM) image of the as-solidified surface of covetic copper with about 5 wt % carbon content using graphite as the carbon source. The covetic copper material produced by the electron beam method is dense and has a uniform surface structure. The surface morphology of the covetic copper is similar to that reported for materials made by other processing art that requires the application of large current of hundreds of amperes. (See U.S. Pat. No. 8,541,336; D. R. Forrest, I. Jasiuk, L. Brown, P. Joyce, A. Mansour, and L. Salamanca-Riba "Novel Metal-Matrix Composites with Integrally-Bound Nanoscale Carbon" Proc. Nanotech Conference and Expo 2012, Jun. 18-21, Santa Clara, Calif. CRC Press, 2012).

Preparation of Mixture of Metal-Carbon Precursor.

The metal and carbon components of a desired covetic composition are mixed together in the targeted weight or molar ratios to form a precursor mixture. For example, a metal, such as copper, or a mixture of metals is combined with, e.g., graphite, carbon black, or graphene, at a desired ratio. Typically, the carbon content is in the range of about 1 wt % to about 10 wt %, preferably in the range of about 2 wt % to about 5 wt %. Preferably, the metal (or metal alloy) composition accounts for about 90 to 99 wt %, although up to 10 wt % of other materials such as ceramics, other forms of carbon such as nanotubes, and nanofibers may be included in place of some of the metal or alloy. For large scale process, metal scrap, chips, filings, or compacted sponges can be used in place of metal powder as metal source.

In some cases it is desirable to comminute or grind the carbon and metal (e.g., a metal powder) together to achieve a relatively uniform mixture prior to proceeding to degassing. In one typical specific example, about 14 g of copper powder (Aldrich Chemical Company, 99% pure) and about 0.7 g of graphite powder (Fisher Chemical Company, G-67 graphite powder) were mixed inside a fume hood using agate mortar and pestle. Subsequently, the mixture was ball milled in isopropyl alcohol (IPA) to prepare the precursor. The milling time was about 2 to 3 hours. The particle size of the metal powder was in the range of about 0.5 to 40 micrometers. The oxygen content typically is less than about 1000 ppm.

Loading of the Chamber.

The metal-carbon precursor is loaded into a crucible (such as graphite crucible typically used for electron beam-evaporation, about 1 inch in diameter), the crucible is placed into an electron beam hearth, and the electron beam melt processing chamber is pressurized to a desired vacuum. The vacuum processing chamber used herein has a base pressure of $10^{-7}$ Torr (or $10^{-10}$ atmosphere). It typically requires overnight pumping to achieve such a vacuum level.

Degassing.

An electron gun equipped on the electron beam melting system generates an electron beam under high voltage. The metal-carbon precursor is degassed by slowly increasing heating power of the electron beam. Preferably, an electron beam hearth operates at about 8 kilovolts (KV) with beam current up to about 200 milliampere (mA). The rate of heating is in the range of 1 to 10° C./minute. For the initial heating, the electron beam current should be increased at a rate such that the pressure in the electron beam chamber does not exceed $10^{-4}$ Torr. Electrons in the electron beam enter the precursor, flow through the precursor, and exit through the grounded crucible.

Melting and Covetic Reaction.

Melt the metal-carbon precursor by rapidly increasing the heating power of the electron beam to a desired level. A monitoring and feedback control system can be utilized for automatic control of the heating power of the electron beam melting system. The electron beam is focused by a magnetic field and directed to the precursor inside the crucible. When the electron beam hits the precursor material, an electric current is generated in which electrons in the electron beam enter the precursor material, flow through the precursor, and exit through the crucible. The kinetic energy of the electrons converts to heat energy to heat up the precursor and create a precursor-melt. The covetic reaction between metal and carbon takes place under the influence of the electrical current flowing through the melted metal-carbon precursor. In the electron beam melting system, there is an electron beam manipulation or rastering control that allows rapid movement (at frequencies up to thousands of Hz) of the electron beam. This effectively creates a vortex in the melted precursor and thus facilitates further mixing and the covetic reaction between metal and carbon. The rate of heating is in the range of 10 to 200° C./minute.

Cooling and Removal from Chamber

After a few minutes of stirring, the electron gun power is shut off the power to turn off the beam. The melt is then allowed to cool and solidify. Once the covetic material is at or near ambient room temperature the reaction chamber is pressurized to ambient atmospheric pressure and the covetic metal is recovered.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The terms "consisting of" and "consists of" are to be construed as closed terms, which limit any compositions or methods to the specified components or steps, respectively, that are listed in a given claim or portion of the specification. In addition, and because of its open nature, the term "comprising" broadly encompasses compositions and methods that "consist essentially of" or "consist of" specified components or steps, in addition to compositions and methods that include other components or steps beyond those listed in the given claim or portion of the specification. Recitation of ranges of values herein are merely intended to serve as a shorthand method of referring individually to each separate value falling within the range, unless otherwise indicated herein, and each separate value is incorporated into the specification as if it were individually recited herein. All numerical values obtained by measurement (e.g., weight, concentration, physical dimensions, removal rates, flow rates, and the like) are not to be construed as absolutely precise numbers, and should be considered to encompass values within the known limits of the measurement techniques commonly used in the art, regardless of whether or not the term "about" is explicitly stated. All methods described herein can be performed in any suitable order unless otherwise indicated herein or otherwise clearly contradicted by context. The use of any and all examples, or exemplary language (e.g., "such as") provided herein, is intended merely to better illuminate certain aspects of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The embodiments of the invention in which an exclusive property or privilege is claimed are defined as follows:

1. A method for preparing a covetic metal-carbon composite material comprising the sequential steps of:

(a) passing an electric current of less than about 1 ampere through a precursor mixture of a metal and a carbon material in an electrically conductive, grounded vessel by irradiating the mixture with an electron beam under vacuum at a pressure of less than about $10^{-3}$ Torr, wherein the electron beam has a sufficient beam energy to heat the mixture to a temperature below the melting point of the mixture at a heating rate in the range of about 1 to about 10° C. per minute (° C./min) to expel dissolved gasses therefrom;

(b) increasing the electron beam energy to a level sufficient to heat the precursor composition at a heating rate in the range of about 10 to about 200° C./min to a temperature sufficient to melt the mixture, cause convention mixing therein, and thereby convert the precursor mixture to a covetic metal-carbon composite material;

(c) terminating the electron beam to allow the mixture to cool to ambient room temperature while maintaining the pressure at less than about $10^{-3}$ Torr; and (d) recovering the resulting covetic metal-carbon composite material from the vessel at ambient atmospheric pressure.

2. The method of claim 1, wherein the metal is selected from the group consisting of copper, aluminum, silver, gold, platinum, iron, nickel, and alloys thereof.

3. The method of claim 1, wherein the metal is in the form of a powder.

4. The method of claim 1, wherein the metal comprises copper.

5. The method of claim 1, wherein the carbon material is a particulate carbon material.

6. The method of claim 5, wherein the particulate carbon material comprises carbon microparticles, carbon nanoparticles, or a combination thereof.

7. The method of claim 1, wherein the vessel is a grounded graphite crucible.

8. The method of claim 1, wherein the pressure in steps (a), (b) and (c) is in a range of about $10^{-3}$ Torr to about $10^{-7}$ Torr.

9. The method of claim 1, wherein the carbon material comprises graphite.

10. The method of claim 1, wherein the carbon material comprises carbon black.

11. The method of claim 1, wherein the carbon material is selected from the group consisting of graphene, carbon nanotubes, and carbon nanofibers.

12. The method of claim 1, wherein the carbon comprises carbon nanotubes, carbon nanofibers, or a combination thereof, in which the nanotubes, nanofibers, or both also comprise nanoparticles of one or more metal attached to or encapsulated within the nanotubes or nanofibers.

13. The method of claim 1, wherein the electron beam is rastered across the precursor mixture during step (a), step (b) or both steps (a) and (b).

14. The method of claim 1, wherein the metal comprises copper and the carbon material comprises graphite or carbon black.

15. The method of claim 1, wherein the metal comprises copper and the carbon material comprises graphite.

16. The method of claim 1, wherein the carbon comprises about 1 to about 10 percent by weight (wt %) based on the total weight of the precursor mixture.

* * * * *